US005647336A

United States Patent [19]

Piock et al.

[11] Patent Number: 5,647,336

[45] Date of Patent: Jul. 15, 1997

[54] DEVICE FOR INTRODUCING FUEL INTO A COMBUSTION CHAMBER OF AN INTERNAL COMBUSTION ENGINE

[75] Inventors: Walter Piock; Martin Wirth, both of Hitzendorf; Günter Karl Fraidl, Pirka, all of Austria

[73] Assignee: AVL Gesellschaft Für Verbrennungskraftmaschinen Und Messtechnik m.b.H. Prof.Dr.Dr.h.c. Hans List, Graz, Austria

[21] Appl. No.: 606,917

[22] Filed: Feb. 26, 1996

[30] Foreign Application Priority Data

Feb. 27, 1995 [AT] Austria ..... 353/95

[51] Int. Cl.[6] ..... F02M 67/04

[52] U.S. Cl. ..... 123/532

[58] Field of Search ..... 123/250, 292, 123/531, 532, 534

[56] References Cited

U.S. PATENT DOCUMENTS 5,020,494 6/1991 Plohberger et al. ..... 123/532 X 5,025,769 6/1991 Plohberger et al. ..... 123/532

5,590,635 1/1997 Piock et al. ..... 123/532

*Primary Examiner*—Tony M. Argenbright

*Attorney, Agent, or Firm*—Watson Cole Stevens Davis, P.L.L.C.

[57] ABSTRACT

A device for introducing fuel into the combustion chamber of an internal combustion engine, includes a unit for fuel delivery and an injection valve for withdrawing compressed gas from the cylinder and injecting the gas together with the delivered fuel into the cylinder, and a mixing space in the front part of the valve for the purpose of gas storage, the injection valve being provided with a valve for control of the gas exchange between the combustion chamber and the mixing space in the front part of the valve. To obtain reproducible operating conditions and an optimum closing time ($E_0$) for the injection valve, the mixing space is connected to one or more sensor elements for measuring the pressure and/or temperature of the mixing space, and that the valve is closed in dependence on the physical quantity measured by the at least one sensor element.

2 Claims, 1 Drawing Sheet

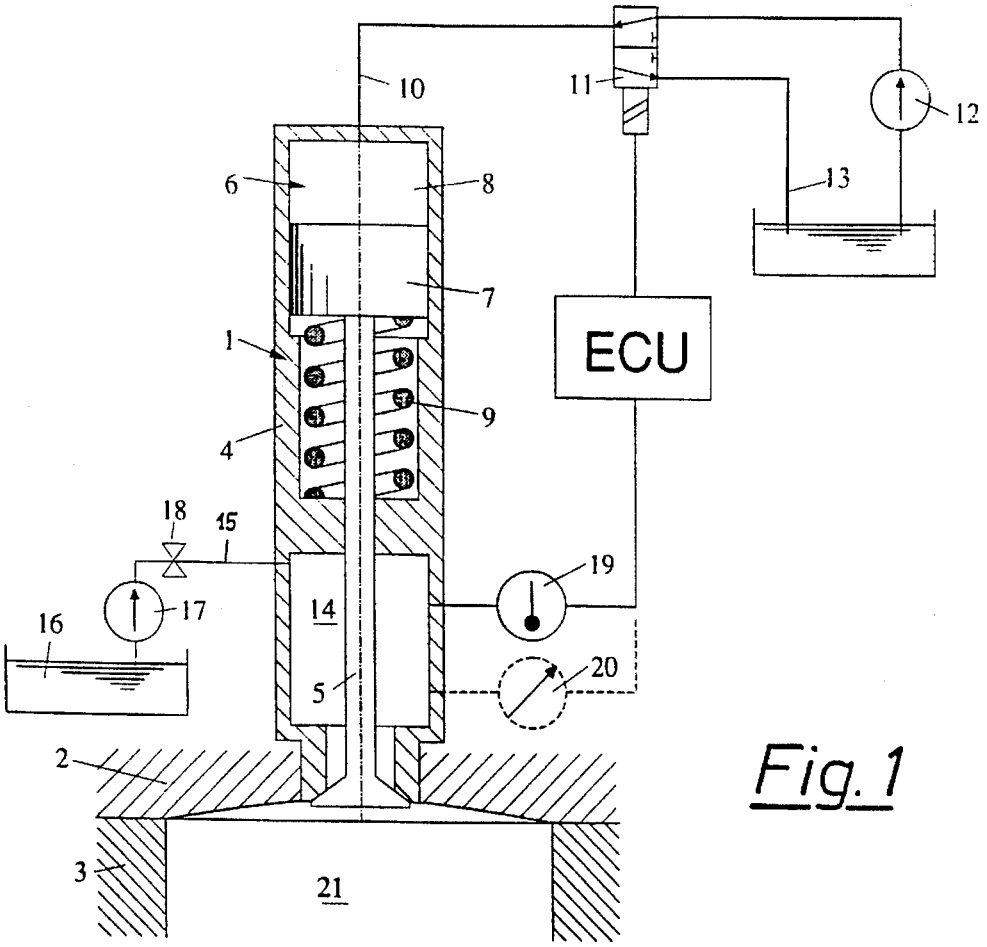
Fig. 1
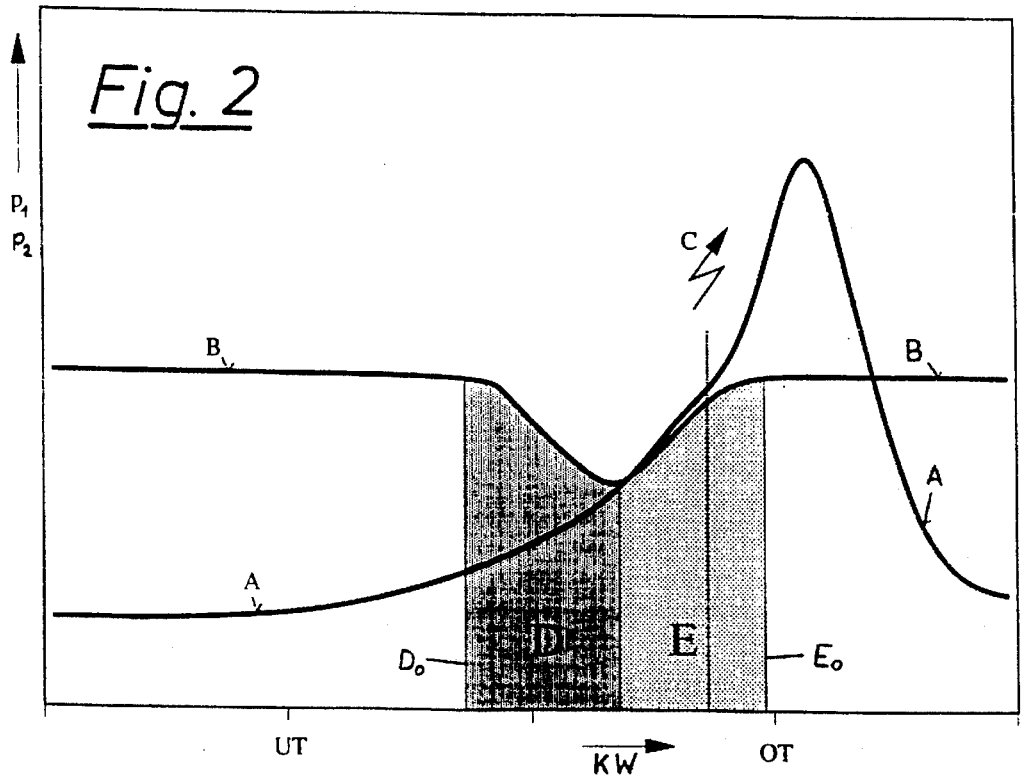

DEVICE FOR INTRODUCING FUEL INTO A COMBUSTION CHAMBER OF AN INTERNAL COMBUSTION ENGINE

BACKGROUND OF THE INVENTION

The invention relates to a device for introducing fuel combustion chamber of an internal combustion engine, comprising a unit for fuel delivery, and an injection valve for withdrawing compressed gas from the cylinder and injecting the gas together with the delivered fuel into the cylinder, with a mixing space in the front part of the valve for the purpose of gas storage, the injection valve being provided with a valve for control of the gas exchange between the combustion chamber and the mixing space in the front part of the valve.

DESCRIPTION OF THE PRIOR ART

In European Patent No. 0 328 602 a device of the above type is described, wherein compressed gas is withdrawn from the cylinder during a working cycle and stored temporarily, and is injected into the cylinder together with the fuel during the subsequent working cycle, the withdrawal of a small amount of hot gas from the cylinder being effected with controlled timing via a valve opening into the combustion chamber of the cylinder. Into the supply of hot gas stored in the valve space of the valve, fuel is injected such that an essentially homogeneous fuel-gas mixture is produced. During the subsequent working cycle this fuel-gas mixture is injected into the cylinder through the valve opening into the cylinder. In a variant of the known device the duration of injection and the injected quantity are varied in dependence on operational parameters of the engine, though mostly independently of each other. If the operational parameters remain unchanged, i.e., same load, engine speed, etc., the injection valve invariably opens and closes at a defined angle of the crankshaft. This implies, however, that the point in time when the valve closes must be chosen such that even in the least desirable instance no combustion will take place in the mixing space, in order to prevent the formation of carbon deposits. On the other hand, a late closing of the valve is desirable during the compression phase in order to keep the pressure in the mixing space in the front part of the valve as high as possible. Due to the distance between the ignition source and the injection valve, and taking into account the velocity of flame propagation, it is possible for the valve to close at a point in time much later than the actual ignition time. If the closing time of the injection valve is set in accordance with the state of the art, i.e., at a fixed point in time, the cyclical fluctuations typical of all spark-ignition engines will lead to strong fluctuations in the storage pressure in the mixing space, and thus to considerable differences in injection pressure, and the pressure ratio between mixing passage and combustion chamber will not be readily reproducible.

SUMMARY OF THE INVENTION

It is an object of the invention to avoid such disadvantages and to permit constant, reproducible operating conditions in a device of the above type.

In the invention this is achieved by providing that the mixing space be connected to one or more sensor elements for measuring the pressure and/or temperature of the mixing space, and that the closing of the valve be made dependent at least on the physical quantity measured by the at least one sensor element. It is preferably provided that the sensor element be connected to an electronic control unit feeding a closing signal, which is generated in dependence on the quantity measured, to a hydraulic, pneumatic, or electronic valve actuating device.

The closing time of the injection valve is directly determined by the physical conditions prevailing in the mixing space, such as temperature and/or pressure. In this way it is possible to obtain maximum pressure in the mixing space, which is subject to very small cyclical fluctuations only. The closing time is set in such a way that no combustion processes can take place in the mixing space. For a given operating point of the engine the closing time of the valve possible under these circumstances may be determined with the use of a typical pressure or temperature value. This value is used as a control or correcting variable, which, rather like the knocking control used for adjustment of the ignition time, will enable the latest possible closing time of the valve to be set while preventing the flame from entering the mixing space, thus permitting the highest possible pressure to be stored in the mixing space.

BRIEF DESCRIPTION OF THE DRAWING

The invention will be further described with reference to the accompanying drawing, in which FIG. 1 is a longitudinal section of the injection valve of the invention, and FIG. 2 a pressure-crank angle diagram.

DETAILED DESCRIPTION OF THE PREFERRED EMBODIMENT

FIG. 1 gives a schematical representation of an injection valve 1 of an internal combustion engine not shown here in detail. The cylinder head has the reference number 2, a cylinder of the engine is indicated by 3. The injection valve 1 is provided with a valve 5, which slides in the housing 4 of the injection valve 1. The valve 5 is operated by an actuating device 6, for example, a hydraulic unit. This actuating device 6 could also be a pneumatic or electric unit. In the hydraulic actuating device 6 shown in FIG. 1, an actuating plunger 7 of the valve 5 is subject to hydraulic pressure in the pressure chamber 8 against the force of a spring 9, so that the valve 5 is forced open. When the pressure is relieved the valve 5 is closed by the action of the spring 9. A hydraulic line 10 leads into the pressure chamber 8, which line can be connected to a pump 12 or the like by means of a control valve 11. In a second position of the control valve 11 the pressure chamber 8 can be depressurized via a pressure relief line 13. The control valve 11 is operated by an electronic control unit (ECU).

Inside the valve housing 4 a mixing space 14 is provided, which is flow-connected with the combustion chamber 21 of the engine when the valve 5 is open. A fuel flow passage 15 opens into the mixing space 14, via which fuel can be injected into the mixing space 14. The fuel supply system is indicated by the fuel container 16, the fuel delivery unit 17, a fuel valve 18 and the passage 15. For measuring the temperature and/or pressure in the mixing space 14 a temperature sensor 19 and/or a pressure sensor 20 is provided whose data are transmitted to the ECU control unit.

In the pressure-crank angle diagram of FIG. 2 the cylinder pressure $p_1$ (symbolized by line A) and the pressure $p_2$ in the mixing space 14 (symbolized by line B) are plotted against the crank angle KW. The arrow C indicates the ignition time in the upper dead center (OT). The symbol UT refers to lower dead center. The injection phase of the injection valve 1 is referred to as D, the reference $D_0$ marking the opening time and $E_0$ the closing time of the injection valve 1. During the injection phase D the valve 5 is open, and the content of the mixing space 14 is decharged into the combustion chamber 21 inside the cylinder 3. In devices of the type described at the beginning of this paper the injection phase D is directly followed by the recharging phase E of the injection valve 1, during which gas flows into the mixing space 4 while the pressure in the combustion chamber is rising. The recharging phase E must be completed before any combustion takes place inside the mixing space 14. After the subsequent injection of fuel into the supply of hot gas stored in the mixing space 14, the mixing space 14 is unloaded once more in the following cycle during the injection phase D. The injection valve thus remains open during the injection phase D and the recharging phase E.

To obtain high injection pressures during the injection phase D it is an advantage if the closing time $E_0$ of the injection valve 4 is set as late as possible, although it should not be set too late in order to reliably prevent any combustion in the mixing space 14. To determine the optimum closing time $E_0$ of the injection valve 1, the invention provides that at least one temperature sensor 19 and/or pressure sensor 20 be employed for monitoring the temperature and/or pressure inside the mixture space 14, as is shown in FIG. 1.

We claim:

1. A device for introducing fuel into a combustion chamber of an internal combustion engine, comprising a unit for fuel delivery, and an injection valve for withdrawing compressed gas from a cylinder and injecting said gas together with said delivered fuel into said cylinder, with a mixing space in a front part of said valve for the purpose of gas storage, said injection valve being provided with a valve for control of the gas exchange between said combustion chamber and said mixing space in said front part of said valve, wherein said mixing space is connected to at least one sensor element for measuring at least one of pressure and temperature of said mixing space, and wherein the closing of said valve is made dependent at least on the physical quantity measured by said at least one sensor element.

2. A device according to claim 1, wherein said at least one sensor element is connected to an electronic control unit feeding a closing signal, which is generated in dependence on the quantity or quantities measured, to a hydraulic, pneumatic, or electronic valve actuating device.

* * * * *